US007485364B2

(12) United States Patent
Yamamoto et al.

(10) Patent No.: US 7,485,364 B2
(45) Date of Patent: Feb. 3, 2009

(54) POLYURETHANE ELASTIC FIBER AND PROCESS FOR PRODUCING SAME

(75) Inventors: Taro Yamamoto, Moriyama (JP); Masanori Doi, Moriyama (JP)

(73) Assignee: Asahi Kasei Fibers Corporation, Osaka (JP)

( * ) Notice: Subject to any disclaimer, the term of this patent is extended or adjusted under 35 U.S.C. 154(b) by 390 days.

(21) Appl. No.: 10/591,671

(22) PCT Filed: Feb. 28, 2005

(86) PCT No.: PCT/JP2005/003334

§ 371 (c)(1),
(2), (4) Date: Sep. 1, 2006

(87) PCT Pub. No.: WO2005/083163

PCT Pub. Date: Sep. 9, 2005

(65) Prior Publication Data

US 2007/0196650 A1 Aug. 23, 2007

(30) Foreign Application Priority Data

Mar. 2, 2004 (JP) ..... 2004-057415

(51) Int. Cl.
*D02G 3/00* (2006.01)

(52) U.S. Cl. ..... 428/372; 51/298; 385/143

(58) Field of Classification Search ..... 428/372, 428/364, 394; 51/298; 385/143
See application file for complete search history.

(56) References Cited

U.S. PATENT DOCUMENTS 4,525,420 A * 6/1985 Imai et al. ..... 428/372
4,605,594 A * 8/1986 Owens et al. ..... 428/373
4,909,597 A * 3/1990 Parker et al. ..... 385/143
5,078,754 A * 1/1992 Jefferies et al. ..... 51/298
5,369,916 A * 12/1994 Jefferies et al. ..... 451/532
5,443,775 A * 8/1995 Brannon ..... 264/143
6,027,803 A * 2/2000 Jacobson et al. ..... 428/372
6,353,049 B1 * 3/2002 Doi et al. ..... 524/432
6,406,788 B1 * 6/2002 Doi et al. ..... 428/364
6,468,652 B1 * 10/2002 Tsuru et al. ..... 428/364
6,716,523 B2 * 4/2004 Carney et al. ..... 428/372
6,758,727 B2 * 7/2004 Coad ..... 451/41
7,250,118 B2 * 7/2007 Brady et al. ..... 252/363.5

(Continued)

FOREIGN PATENT DOCUMENTS

JP 60-239519 11/1985

(Continued)

OTHER PUBLICATIONS

Korean Patent Office Action, Mailed Apr. 25, 2007 and Issued in priority Korean Patent Application 10-2006-7017745.

(Continued)

*Primary Examiner*—N. Edwards
(74) *Attorney, Agent, or Firm*—Staas & Halsey LLP

(57) ABSTRACT

A polyurethane elastic fiber, containing inorganic compound particles that have an average particle size of 0.5 to 5 mm and that show a refractive index of 1.4 to 1.6, having at least one protruded portion that has a maximum width of 0.5 to 5 μm, in the fiber surface, per 120-μm length in the fiber axis direction.

11 Claims, 2 Drawing Sheets

U.S. PATENT DOCUMENTS

2007/0196650 A1 * 8/2007 Yamamoto et al. ..... 428/375

FOREIGN PATENT DOCUMENTS

| | | |
|---|---|---|
| JP | 5033217 | 9/1993 |
| JP | 6-123067 | 5/1994 |
| JP | 10-259577 | 9/1998 |
| JP | 2002-363825 | 12/2002 |
| JP | 2003-113535 | 4/2003 |
| JP | 2005-120545 | 5/2005 |
| KR | 1992-003250 | 4/1992 |

OTHER PUBLICATIONS

Database WPI Week 199311 Derwent Publications Ltd., London, GB; AN 1993-089118.

European Patent Search Report issued Nov. 12, 2007 in application 05719651.1-1217.

* cited by examiner

POLYURETHANE ELASTIC FIBER AND PROCESS FOR PRODUCING SAME

CROSS REFERENCES TO RELATED APPLICATIONS

This application claims the benefit of PCT International Application Number PCT/JP2005/003334 filed Feb. 28, 2005 and Japanese Application No. 2004-057415, filed Mar. 2, 2004 in Japan, the disclosures of which are incorporated herein by reference.

TECHNICAL FIELD

The present invention relates to a polyurethane fiber excellent in stability during texturing and to a process for producing the same.

BACKGROUND ART

A polyurethane elastic fiber is a stretchable fiber excellent in an elastic function, and is mixed and knitted or woven with a polyamide fiber, a polyester fiber, cotton, and the like. The resultant fabrics have been widely used in the non-clothing field such as for diapers, bandages, supporters, masks, interior materials of automobiles, nets and tapes as well as in the clothing field such as for foundations, socks, pantyhose, swimwear, sportswear and leotards.

When a polyurethane elastic fiber is used in the field of clothing, the fiber is usually warped and covered, mixed-knitted and mixed-woven, and the resultant fabric is dyed and heat set to give fabric products. When a polyurethane fiber is warped or covered, friction is generated between the fiber and a reed or a guide. Moreover, when a polyurethane elastic fiber is mixed and knitted or woven, friction is generated between the fiber and a guide or a knitting needle. When the friction resistance of the polyurethane elastic fiber is always constant, yarn breakage hardly takes place, and a fabric of high quality having decreased unevenness can be produced. However, actually, yarn breakage caused by a variation in the friction resistance does take place, and unevenness like streaks is occurred to hinder the stability during texturing of the fiber.

In order to improve such texturing stability, imparting a fiber treating agent such as a finish oil to a polyurethane elastic fiber has been commonly done. When a finish oil is imparted in a large amount, the effect of improving the texturing stability is obtained to a certain degree. However, the effect is inadequate. Use of a finish oil in a large amount rather causes a problem of drastic stain on the apparatus, and cannot be said to be economical.

Various investigations on the compositions and adhesion amounts of finish oils have been carried out, and methods of allowing finish oils to contain lubricants such as metallic soaps, silica and silica derivatives have been disclosed (see, for example, Japanese Examined Patent Publication (Kokoku) No. 40-5557, Japanese Unexamined Patent Publication (Kokai) No. 60-239519, Japanese Examined Patent Publication (Kokoku) No. 5-41747, and the like). However, when an insoluble material in a finish oil sticks to a fiber surface, the insoluble material drops off the surface during texturing to cause a problem of fiber scum.

For example, Japanese Examined Patent Publication (Kokoku) No. 58-44767 discloses a method, of lowering the stickiness of a polyurethane elastic fiber, which comprises allowing a polyurethane solution to contain powdery metallic soap in the production step of the polyurethane elastic fiber. However, because the metallic soap is in a dispersed state in the polyurethane solution, the filter and nozzle are clogged to cause a problem of significantly increasing the pressure in the step to impair the step stability.

Furthermore, investigations have also been carried out to improve the texturing stability by modifying the fiber surface, and methods including the following ones have been proposed: a method comprising adding an aliphatic saturated dicarboxylic acid so that the fiber surface is made to have considerable unevenness (Japanese Examined Patent Publication (Kokoku) No. 5-45684); and a method comprising adding barium sulfate having a specific isoelectric point to a polyurethane, and imparting a lubricating finishing agent in combination so that the fiber surface is roughened to have lubricity properties and decreased stickiness (Japanese Patent Publication No. 3279569). However, even these methods cannot make a polyurethane elastic fiber have sufficient texturing stability.

DISCLOSURE OF THE INVENTION

[Problems to Be Solved by the Invention]

The object of the present invention is to provide a polyurethane elastic fiber excellent in texturing stability. The object of the present invention, in more detail, is to provide a polyurethane elastic fiber that shows decreased yarn breakage during warping, mixed-knitting and mixed-weaving, that can form a fabric of high quality having decreased unevenness, and that is economical because an adhesion amount of fiber treating agents such as a finish oil is small, and a process for producing the same.

[Means for Solving the Problems]

As a result of intensively carrying out investigations to solve the above problems, the present inventors have discovered that a polyurethane elastic fiber containing specific inorganic compound particles, and having specific protruded portions on the surface and specific frictional properties shows excellent texturing stability, and they have thus achieved the present invention.

That is, the present invention is as explained below.

(1) A polyurethane elastic fiber containing inorganic compound particles that have an average particle size of 0.5 to 5 μm, and that show a refractive index of 1.4 to 1.6, and having at least one protruded portion that has a maximum width of 0.5 to 5 μm in the fiber surface, per 120-μm length in the fiber axis direction.

(2) The polyurethane elastic fiber according to 1 mentioned above, wherein the polyurethane elastic fiber contains from 0.05 to 10% by weight of inorganic compound particles.

(3) The polyurethane elastic fiber according to 1 or 2 mentioned above, wherein the inorganic compound particles are porous silica having a specific surface area of 100 to 800 $m^2/g$.

(4) The polyurethane elastic fiber according to any one of 1 to 3 mentioned above, wherein the coefficient of dynamic friction thereof against a knitting needle is from 0.2 to 0.6.

(5) The polyurethane elastic fiber according to any one of 1 to 4 mentioned above, wherein the coefficient of static friction thereof against the polyurethane elastic fiber is from 0.3 to 0.6.

(6) The polyurethane elastic fiber according to any one of 1 to 5 mentioned above, wherein the change with time (after allowing the polyurethane elastic fiber to stand for 16 hours at 70° C.) in the coefficient of static friction thereof against a nylon yarn is 0.1 or less.

(7) A process for producing a polyurethane elastic fiber, which comprises finely dispersing inorganic compound particles having an average particle size of 0.5 to 5 μm and showing a refractive index of 1.4 to 1.6 in an amide-type polar solvent, and dry spinning a polyurethane spinning dope containing from 0.05 to 10% by weight, based on the polyurethane, of the inorganic compound particles.

The present invention is explained below in detail.

The polyurethane elastic fiber of the present invention has, in the fiber surface, at least one relatively large protruded portion having a maximum width of 0.5 to 5 μm, per 120-μm length in the fiber axis direction. When the protruded portion has a maximum width of less than 0.5 μm, the texturing stability becomes insufficient. When the protruded portion has a maximum width more than 5 μm, the protruded portion becomes a defect, and the physical properties of the fiber becomes poor. The number of protruded portions must be at least 1 per 120-μm length in the fiber surface in the fiber axis direction. When the number is less than the above value, excellent texturing stability cannot be obtained.

The protruded portion herein designates a protrudent portion with respect to the average surface of the fiber surface, and the shape does not matter as long as the maximum width is from 0.5 to 5 μm. The maximum height thereof from the fiber surface is preferably from 0.05 to 2 μm.

The polyurethane elastic fiber of the present invention contains inorganic compound particles having an average particle size of 0.5 to 5 μm and showing a refractive index of 1.4 to 1.6. When the polyurethane elastic fiber contains such inorganic compound particles, the fiber has the above shape properties of the fiber surface, and shows excellent physical properties.

When the average particle size is less than 0.5 μm, a protruded portion having an adequate size cannot be formed in the fiber surface. As a result, excellent texturing stability of the fiber cannot be obtained. Moreover, when the average particle size exceeds 5 μm, the particles are likely to clog a filter in the production step of the polyurethane elastic fiber, or the fiber has poor physical properties due to defects formed by the particles. As a result, yarn breakage is likely take place during texturing, or the like procedure.

Furthermore, when the refractive index of the particles is outside the range of 1.4 to 1.6, a refractive index difference between the particles and the substrate polyurethane polymer becomes significant. As a result, the transparency of the polyurethane elastic fiber is lowered, and the color tone is changed. In particular, for a clear type yarn, a slight uneven size of the yarn in the fiber axis direction is stressed, and the appearance and quality of the fabric or fabric products become poor.

The polyurethane elastic fiber of the present invention contains the above inorganic compound particles having an average particle size of 0.5 to 5 μm and showing a refractive index of 1.4 to 1.6 in an amount of preferably 0.05 to 10% by weight based on the polyurethane elastic fiber, more preferably 0.1 to 10% by weight, and still more preferably 0.1 to 4% by weight. When the content of the inorganic compound particles falls in the above range, the following advantages are obtained: excellent texturing stability of the fiber is obtained; during production of the fiber, excellent spinning stability is obtained; and the physical properties of the fiber become excellent.

The inorganic compound particles are satisfactory as long as the particles meet the requirement that the polyurethane elastic fiber has at least one protruded portion that has a maximum width of 0.5 to 5 μm in the fiber surface, per 120-μm length in the fiber axis direction.

In the present invention, examples of the inorganic compound particles include alumina, magnesium hydroxide, magnesium carbonate, calcium carbonate, calcium silicate, magnesium silicate, kaolin, mica and silica. Of these, amorphous synthetic silica is preferred, and porous synthetic silica having a specific surface area of 100 to 800 $m^2/g$ is more preferred. The physical properties of synthetic silica can be adjusted by the production process. Typical production processes include: a wet process for producing silica that comprises mixing sodium silicate and sulfuric acid to form a silicic acid sol, polymerizing the silicic acid sol to form primary particles, and adjusting the size of agglomerates by suitable reaction conditions; and a dry process for producing silica particles that comprises burning and hydrolyzing tetrachlorosilicon in a gas phase.

In the present invention, porous silica obtained by the former wet process wherein three-dimensional agglomerates are formed from the primary particles under suitable reactions conditions, and the agglomerates are allowed to gel, is appropriate. The internal specific surface area, pore size and physical properties of porous silica can be varied by varying the formation conditions of the primary particles. The porous silica particles have a specific surface area of 100 to 800 $m^2/g$, and more preferably 200 to 800$m^2/g$.

Usually, when a hard inorganic substance such as titanium that has been conventionally used for a fiber is added to a fiber, the contact faces of a guide and a knitting needle are acceleratedly abraded during the production or texturing of the fiber. Although silica is as hard as titanium in general, use of porous silica greatly diminish abrasion of the guide and needle during the production and texturing of a polyurethane elastic fiber because porous silica is structurally brittle.

Silica obtained by a dry process and having no internal specific surface area and silica (white carbon) obtained by a wet process under reaction conditions that stop growth of the agglomerates and having a small or no internal specific surface area are very fine particles having a particle size of 0.1 μm or less. As a result, such silica sometimes has a specific surface area similar to that of porous silica. Because such silica is likely to agglomerate in the solution or yarn, filter clogging is significant. Moreover, because the agglomerates are dense, the abrasion of the guide and needle is significant.

A surface of the porous silica industrially obtained by the above methods is usually covered with hydroxyl groups and, as a result, has hydrophilicity. However, the porous silica may also be surface treated so that the surface hydroxyl groups are masked and the porous silica has hydrophobicity. The porous silica may be made hydrophobic by, for example, the following procedures: a procedure of chemically reacting a silanol group on the silica surface with an organosilicon compound such as trimethylsilane chloride or bis(octadecyl)silane dichloride; and a procedure of hydrolyzing alkyl orthosilicate in a solvent to directly give hydrophobic silica. Silica obtained by any of the production procedures may be used as long as the silica thus obtained meet requirements of the above particle properties.

Hydrophilic porous silica is economically excellent. Hydrophobic porous silica has high affinity with an organic solvent, and is excellent in dispersibility in a polyurethane solution. The hydrophobic porous silica therefore improves the stability during production step of a polyurethane elastic fiber. An adsorption amount of di-n-butylamine (DBA value) adsorbed to hydroxyl groups is used as a measure of the hydrophobicity of a silica surface. As to hydrophobic porous silica having a DBA value of 0 to 300 meq/kg is preferred because it is excellent in dispersibility.

The polyurethane elastic fiber of the present invention preferably has a coefficient of dynamic friction against a knitting needle of 0.2 to 0.6. When the coefficient of dynamic friction against a knitting needle is in the above range, the friction against a guide, a guide bar, or the like, becomes appropriate during texturing. The yarn therefore shows excellent running stability, and a variation in tension of the polyurethane elastic fiber during its insertion into a fabric is suppressed. As a result, the quality of the resultant fabric is improved.

Furthermore, the polyurethane elastic fiber of the invention shows a decreased variation in tension caused by a change in the dynamic friction against a knitting needle. In the measurement of a coefficient of dynamic friction against a knitting needle, when a change in the tension ($T_1$) of the polyurethane elastic fiber on the input side that suffers a friction resistance of the knitting needle, when the fiber runs for 20 minutes, is 1.0 cN or less, a change in the tension of the fiber caused by a knitting needle, a reed, or the like, is suppressed during texturing, and the quality of the fabric thus obtained is improved.

The polyurethane elastic fiber of the present invention preferably has such friction properties that the coefficient of static friction against a polyurethane elastic fiber falls in the range from 0.3 to 0.6. When the coefficient of static friction against a polyurethane elastic fiber is in the above range, the polyurethane wound on a paper bobbin shows excellent shape stability, and yarn breakage caused by a wound yarn edge-drop and yarn breakage caused by sticking of polyurethane fibers during texturing can be suppressed. In addition, the coefficient of static friction against a polyurethane elastic fiber designates a value obtained by measuring a coefficient of static friction using the polyurethane elastic fibers to be measured.

The polyurethane elastic fiber of the invention preferably shows a change with time of a coefficient of static friction against a nylon yarn (after allowing the fiber to stand for 16 hours at 70° C.) of 0.1 or less. The condition of leaving the fiber at 70° C. for 16 hours is an accelerating evaluation that takes a change with time at room temperature into consideration. A polyurethane elastic fiber showing a change in friction with time under the above condition of 0.1 or less shows only a slight change in friction properties with time, and can maintain excellent texturing stability over a long period of time.

In the present invention, the polyurethane elastic fiber preferably meets the above requirement of a coefficient of dynamic friction against a knitting needle, and the above requirement of a coefficient of static friction against a polyurethane elastic fiber, and preferably maintains good unwindability over a long period of time.

The substrate polymer of the polyurethane elastic fiber of the invention can be obtained by, for example, reacting a polymer polyol, a diisocyanate, a chain extender having polyfunctional active hydrogen atoms and a chain terminator having a monofunctional active hydrogen atom.

Examples of the polymer polyol include various diols composed of a substantially linear homo- or copolymer such as polyester diols, polyether diols, polyesteramide diols, polyacryl diols, polythioester diols, polythioether diols, polycarbonate diols, or a mixture or a copolymer of these substances. Preferred examples thereof are polyalkylene ether glycols such as a polyoxyethylene glycol, a polyoxypropylene glycol, a polytetramethylene ether glycol, a polyoxypentamethylene glycol, a copolymerized polyether glycol formed from a tetramethylene group and a 2,2-dimethylpropylene group, a copolymerized polyether glycol formed out of a tetramethylene group and a 3-methyltetramethylene group, or a mixture of these substances. Of these substances, a polytetramethylene ether glycol, a copolymerized polyether glycol formed out of a tetramethylene group and a 2,2-dimethylpropylene group are appropriate in view of an excellent elastic function.

The number average molecular weight is preferably from 500 to 5,000, and more preferably from 1,000 to 3,000.

Examples of the diisocyanate are aliphatic, alicyclic and aromatic diisocyanates, and the like. Specific examples thereof include 4,4'-diphenylmethane diisocyanate, 2,4'-diphenylmethane diisocyanate, 2,4- or 2,6-tolylene diisocyanate, m- or p-xylylene diisocynate, α, α, α', α'-tetramethylxylylene diisocyante, 4,4'-diphenylether diisocyanate, 4,4'-dicyclohexyl diisocyanate, 1,3- or 1,4-cyclohexylene diisocyanate, 3-(α-isocyanatoethyl)phenyl isocyanate, 1,6-hexamethylene diisocyanate, trimethylene diisocyanate, tetramethylene diisocyanate, isophorone diisocyanate, a mixture or copolymer of these compounds. Of these compounds, 4,4'-diphenylmethane diisocyanate is preferred.

Examples of the chain extender having polyfunctional active hydrogen atoms include hydrazine, polyhydrazine, low molecular weight diols such as ethylene glycol, 1,2-propylene glycol, 1,3-propylene glycol, 1,3-butanediol, 1,4-butanediol, 1,5-pentanediol, 1,6-hexanediol, 2,2-dimethyl-1,3-propanediol, diethylene glycol, dipropylene glycol, 1,4-cyclohexanedimethanol and phenyldiethanolamine, and bifunctional amines such as ethylenediamine, 1,2-propylenediamine, 1,3-propylenediamine, 2-methyl-1,5-pentadiamine, triethylenediamine, m-xylylenediamine, piperazine, o-, m-, or p-phenylenediamine, 1,3-diaminocyclohexane, 1,4-diaminocyclohexane, 1,6-hexamethylenediamine and N,N'-(methylenedi-4,1-phenylene)bis[2-(ethylamino)urea].

These compounds may be used singly or in a mixture. A bifunctional amine is preferred to a low molecular weight diol. Preferred examples of the chain extender include ethylenediamine to be used singly, or a mixture of ethylene diamine and 5 to 40% by mole of other diamines that are at least one compound selected from the group consisting of 1,2-propylenediamine, 1,3-diaminocyclohexane and 2-methyl-1,5-pentadiamine. More preferably, ethylenediamine is used singly.

Examples of the chain terminator having a monofunctional active hydrogen atom include monoalcohols such as methanol, ethanol, 2-propanol, 2-methyl-2-propanol, 1-butanol, 2-ethyl-1-hexanol and 3-methyl-1-butanol, monoalkylamines such as isopropylamine, n-butylamine, t-butylamine and 2-ethylhexylamine, and dialkylamines such as diethylamine, dimethylamine, di-n-butylamine, di-t-butylamine, diisobutylamine, di-2-ethylhexylamine and diisopropylamine. These compounds may be used singly or in a mixture. A monoalkylamine that is a monofunctional amine or a dialkylamine is preferred to a monoalcohol.

Known technologies of polyurethane formation reactions can be used for the process for producing starting material polymers of the polyurethane elastic fiber in the present invention. For example, a urethane prepolymer having isocyanate groups at molecular terminals is synthesized by reacting a polyalkylene ether glycol and diisocyanate while the diisocyanate is present in an excessive amount, and then the urethane prepolymer is subjected to a chain extension reaction with an active hydrogen-containing compound such as a bifunctional amine to give a polyurethane polymer.

A preferred polymer substrate of the polyurethane elastic fiber of the invention is a polyurethane urea polymer obtained by the following procedure: a polyalkylene ether glycol having a number average molecular weight of 500 to 5,000 is reacted with an excessive amount of a diisocyanate to give a synthesized prepolymer having isocyanate groups at the molecular terminals; the prepolymer is subsequently reacted with a bifunctional amine and a monofunctional amine.

As to the operation of the polyurethane formation reaction, during the synthesis of a polyurethane prepolymer or during the reaction of a urethane prepolymer and an active hydrogen-containing compound, an amide-type polar solvent such as dimethylformamide, dimethylsulfoxide or dimethylacetamide can be used. The use of dimethylacetamide is preferred.

In the present invention, inorganic compound particles are usually added to the polyurethane elastic fiber by adding the particles to a polyurethane solution. The inorganic compound particles may also be added to a starting material of the polyurethane in advance, or they may be added during a urethane prepolymer reaction or a chain propagation reaction. Moreover, the inorganic compound particles are preferably added to a polyurethane solution in a uniformly dispersed state. When coarse particles formed by significant secondary agglomeration are present in a polyurethane spinning dope, filter clogging and yarn breakage during spinning tend to take place in the production of the polyurethane elastic fiber. Furthermore, the coarse particles form large protruded portions in the polyurethane elastic fiber thus obtained, and the protruded portions become defects of the elastic fiber, and lower the physical properties such as a breaking strength and a breaking elongation. As a preferred procedure, the inorganic compound particles are finely dispersed in an amide-type polar solvent, and the polar solvent is added to a polyurethane polymer to give a polyurethane spinning dope.

Additives conventionally used for a polyurethane elastic fiber other than the above inorganic compound particles such as UV absorbers, antioxidants, light stabilizers, agents for preventing coloring with gas, anti-chlorine agents, coloring agents, delustering agents, lubricants and fillers may be added to the polyurethane spinning dope. When other inorganic base additives are added, the total amount of inorganic base additives is preferably 10% by weight or less in the polyurethane elastic fiber in order to prevent deterioration of the spinning stability and of physical properties caused by excessive addition of the inorganic compound particles.

The polyurethane elastic fiber of the present invention is preferably produced by dry spinning a polyurethane spinning dope obtained by dissolving a polyurethane polymer in an amide-type polar solvent. Dry spinning compared with melt spinning or wet spinning can most firmly form physical crosslinking with a hydrogen bond between hard segments.

The polyurethane spinning dope in the present invention preferably has a polymer concentration of 30 to 40% by weight and a spinning dope viscosity of 100 to 800 Pa·s at 30° C. When the concentration and viscosity are in the above range, the spinning dope production step and the spinning step are smoothly conducted, and the industrial production is easily carried out. For example, when the spinning dope viscosity is excessively high, transport of the spinning dope to the spinning step is difficult, and the spinning dope is likely to gel during the transport. When the spinning dope viscosity is too low, yarn breakage often takes place during spinning, and the yield is likely to be lowered. When the spinning dope concentration is too low, the energy cost is increased due to scattering of the solvent. Moreover, when the spinning dope concentration is too high, the spinning dope viscosity becomes too high. As a result, a problem of transport arises as explained above.

Examples of the finish oil to be imparted to a polyurethane elastic fiber obtained by spinning include a polydimethylsiloxane, a polyester-modified silicone, a polyether-modified silicone, an amino-modified silicone, a mineral oil, a silicone resin, mineral fine particles such as talc and colloidal alumina, powder of mineral salt of a higher aliphatic acid such as magnesium stearate and calcium stearate, and solid wax at room temperature such as a higher aliphatic carboxylic acid, a higher aliphatic alcohol, paraffin and a polyethylene. These materials may be used singly or in an optionally selected combination.

A polyurethane elastic fiber may be allowed to contain an oil agent by the following methods: a method comprising imparting an oil agent to a polyurethane elastic fiber after spinning; a method comprising allowing a spinning dope to contain an oil agent in advance, and spinning the spinning dope; and a method comprising conducting the above two methods. When a finish oil is to be imparted to a fiber subsequent to spinning, there is no specific limitation on the method as long as an oil agent is imparted after forming a fiber; however, the oil is preferably imparted immediately before winding the fiber on a winder. Imparting an oil agent to the fiber subsequent to winding the fiber is difficult because the fiber is hard to unwind from the winding package.

An oil agent can be imparted to the fiber by known methods such as a method comprising contacting a yarn directly after spinning with an oil film formed on the surface of a metal cylinder that is rotating in a finish oil bath, and a method comprising injecting a given amount of an oil agent from a nozzle tip with a guide so that the oil agent adheres to the yarn. Moreover, when a spinning dope is allowed to contain an oil agent, the oil agent can be added at a freely selected time during the production of the spinning dope, and the finish oil is dissolved or dispersed therein.

The polyurethane elastic fiber of the present invention can be mixed-knitted or mixed-woven with natural fibers such as cotton, silk and wool, polyamide fibers such as fibers of nylon 6 and nylon 66, polyester fibers such as fibers of poly(ethylene terephthalate), poly(trimethylene terephthalate) and poly (tetramethylene terephthalate), cation dyeable polyester fibers, cuprammonium rayon, viscose rayon, acetate rayon, and the like, to give a fabric of high quality without unevenness. Alternatively, using these fibers, textured yarns are obtained by covering, interlacing, doubling and twisting, or the like procedure, and the textured yarns are mixed-knitted or mixed-woven to give a fabric of high quality without unevenness.

The polyurethane elastic fiber of the present invention is supplied as a bare yarn particularly in a large amount to fabrics for which polyurethane elastic fibers are used. The polyurethane elastic fiber of the invention is therefore appropriate to warp knitted fabrics that are greatly influenced by the quality of the raw yarn. Examples of the warp knitted fabrics include power net, satin net, raschel lace and two-way tricot. Use of the polyurethane elastic fiber of the invention gives a fabric of high grade having decreased streaks in the warp direction.

Fabrics for which the polyurethane elastic fiber of the present invention is used can be used for various stretch foundations such as swimwear, girdles, brassieres, intimate goods and underwear, tights, pantyhose, waistbands, bodysuits, spats, stretch sportswear, stretch outerwear, medical wear and stretch back fabrics.

[Effect of the Invention]

The polyurethane elastic fiber of the present invention is excellent in stability during texturing, shows decreased yarn breakage during spinning and texturing, and can be used for producing fabrics of high quality with decreased unevenness. Moreover, because use of a large adhesion amount of fiber treating agents that has been conventionally conducted is unnecessary, the apparatus is less stained, and the production of the fiber is economical.

BRIEF DESCRIPTION OF THE DRAWINGS

FIG. 1 is a view schematically showing a method of measuring a coefficient of dynamic friction of a polyurethane fiber against a knitting needle and a variation in tension of a running yarn.

FIG. 2 is a view schematically showing a method of measuring a coefficient ($\mu_{ss}$) of static friction of a polyurethane elastic fiber against a polyurethane elastic fiber and a coefficient ($\mu_{sn}$) of static friction of a polyurethane elastic fiber against a nylon yarn.

FIG. 3 is an electron microscopic photograph of a polyurethane elastic fiber surface in Example 1.

BEST MODE FOR CARRYING OUT THE INVENTION

The present invention is further explained below by making reference to examples. However, the present invention is in no way restricted thereto. In addition, measurement methods and evaluation methods are as explained below.

(1) Average Particle Size of Inorganic Compound Particles

Inorganic compound particles are dispersed in a 1/1 water/ethanol solvent, and the average particle size is measured with a particle distribution analyzer of a laser diffraction scattering method type (trade name of SALD 2000, manufactured by Shimadzu Corporation).

(2) Specific Surface Area of Inorganic Compound Particles

A sample to be measured is subjected to a degassing pretreatment in a reduced atmosphere at 160° C. for 2 hours. The sample is then measured according to the BET method.

(3) Refractive Index of Inorganic Compound Particles

Solvents different from each other in refractive index are prepared. A given amount of inorganic particles are put in each solvent, and the transmittance of each solvent is measured. The refractive index of a solvent that shows a maximum transmittance is defined as the refractive index of the inorganic compound particles.

(4) Measurement of Protruded Portions on Fiber Surface

Using a scanning electron microscope (trade name of JSM 5510LV, manufactured by JEOL), a fiber surface 120 μm long in the fiber axis direction is randomly photographed at 3 points with a magnification 1,000×. A portion where a swell from a smooth fiber surface can be observed from the side in the photographed image, or a portion where a shadow cast by a swell can be observed is defined as a protruded portion. The size of each protruded portion is simply determined with image processing software, and the number of protruded portions having a size of 0.5 to 5 μm in the fiber surface is counted, followed by determining the average.

(5) Breaking Strength, Breaking Elongation

A fiber sample 5 cm long is pulled at a rate of 1,000%/min until the sample is broken, in an atmosphere at 20° C. and 65% RH with a tensile testing machine (trade name of UTM-III-100 type, manufactured by Orientech Co., Ltd., and the strength (cN) and elongation (%) at breakage are measured.

Figure 1:
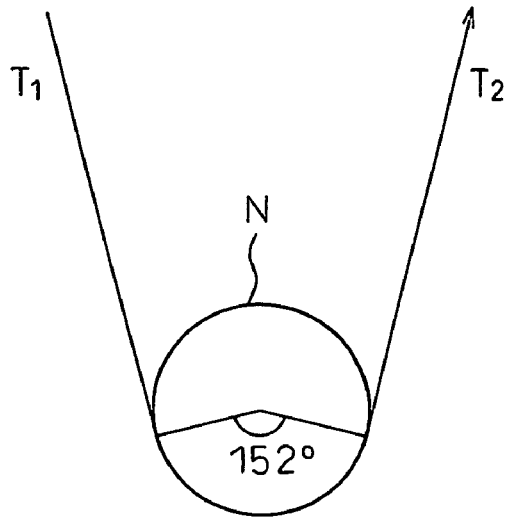
[FIG. 1]

(6) Coefficient of Dynamic Friction against a Knitting Needle and Variation in Tension of Traveling Yarn The coefficient of dynamic friction ($\mu_d$) is determined from the ratio of a yarn tension of a traveling yarn via a knitting needle (trade name of 18Ga200-DX type, manufactured by Koike Kikai Seisakusho K.K.) before the knitting needle to a yarn tension after the knitting needle. That is, a yarn is unwound from a package at a unwinding rate of 100 m/min and is wound at a winding rate of 200 m/min; when a knitting needle (N) is inserted in the running path of the yarn at a friction angle of 152° (0.84π (rad)) as shown in FIG. 1, a yarn tension ($T_1$) on the input side and a yarn tension ($T_2$) on the output side are measured. The coefficient (μd) of dynamic friction is calculated by the following formula:

[Mathematical 1]

$$\mu_d=\ln(T_1/T_2)/0.84\pi \quad (1)$$

The yarn tension on the output side varies during the measurement due to the unevenness of the properties of the yarn friction against the knitting needle. A difference (ΔT) between the maximum and minimum values of the yarn tension is determined. Smaller ΔT shows that the unevenness of the yarn tension during running is smaller and the texturing stability is better.

(7) Coefficient of Static Friction against Polyurethane Elastic Fiber

The coefficient ($\mu_{ss}$) of static friction against a polyurethane elastic fiber is measured with a Joly balance meter (Manufactured by Koa Shokai K.K.) under the conditions explained below. The coefficient of static friction between two polyurethane elastic fibers obtained by the same process is measured.

Figure 2:
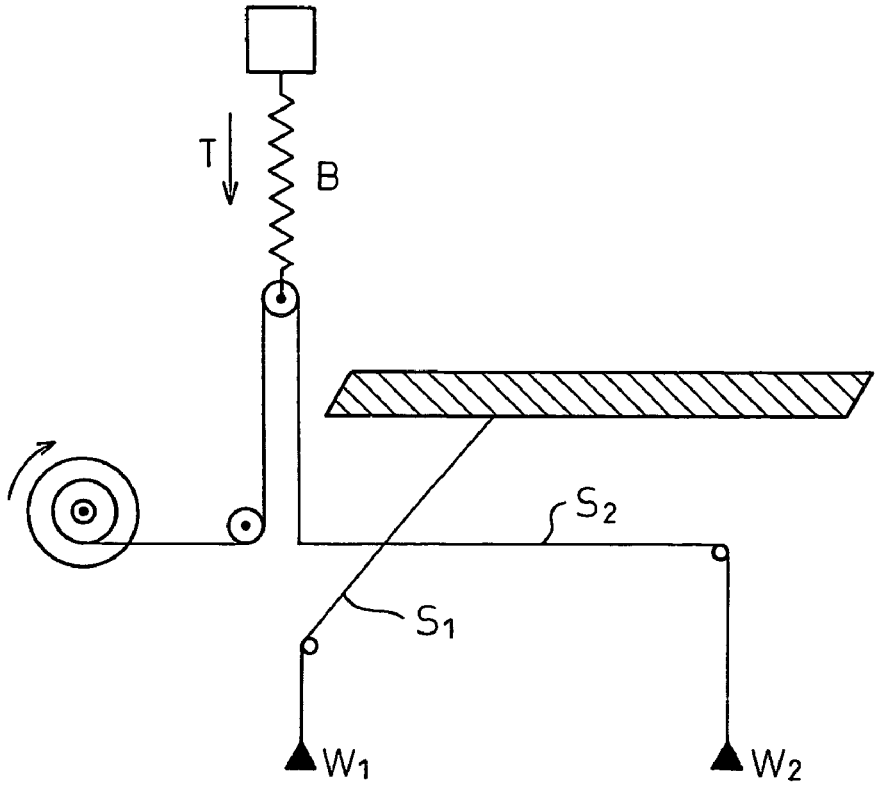
[FIG. 2]

That is, a load of 10 g ($W_1$) is attached to a polyurethane elastic fiber ($S_1$) as shown in FIG. 2, and used as a friction material. A polyurethane elastic fiber ($S_2$), to which a load of 1 g ($W_2$) is attached at one end, is made to run at right angles to the fiber ($S_1$) at a speed of 30 cm/min via a pulley attached to the lower end of a spring (B). The maximum load (T) applied to the spring (B) is then measured. The coefficient ($\mu_s$) of static friction is calculated by the following formula (2):

[Mathematical 2]

$$\mu_s=2\ln(T/4)/\pi \quad (2)$$

(8) Change with Time of Coefficient of Static Friction against Nylon Yarn

The coefficient of static friction against a nylon yarn is measured in the same manner as in the measurement of a coefficient of static friction against a polyurethane fiber except that a nylon yarn is used as a friction material.

That is, a load of 20 g ($W_1$) is attached to a non-treated nylon yarn (trade name of Leona 10/7B, manufactured by Asahi Kasei Fibers Corporation) ($S_1$) as shown in FIG. 2, and used as a friction material. A polyurethane elastic fiber ($S_2$) to which a load of 2 g ($W_2$) is attached at one end is traveled at right angles to the yarn ($S_1$) at a speed of 30 cm/min via a pulley attached to the lower end of a spring (B). The maximum load (T) applied to the spring (B) is then measured. Similarly to (7) mentioned above, the coefficient of static friction is calculated by the above formula (2).

The change with time of a polyurethane elastic fiber is determined in the following manner. The coefficient of static friction of a polyurethane elastic fiber one week after the production thereof is measured. The polyurethane elastic fiber is allowed to stand for 16 hours in an atmosphere at 70° C., and its coefficient of static friction is then measured. A difference ($\Delta\mu_{sn}$) between the former coefficient of static friction and the latter one is determined.

(9) Metal Abrasion

A test yarn is made to run at a feed rate of 43 m/min and a winding rate of 150 m/min while a tension is being applied thereto. The yarn on the running path is hooked by a hooking portion of a fixed stainless steel-made knitting needle (trade name of 18Ga200-DX type, manufactured by Koike Kikai Seisakusho K.K.), and is made to run for 12 hours.

The traces of the running yarn on the hooking portion are observed with an electron microscope, and the scraped state is judged according to the following criteria:

G: no scrape is observed in the running traces, or an extremely slight scrape is observed;

M: although a scrape is observed in the running traces, the scrape exerts no influence on the strength of the knitting needle; and B: the knitting needle is broken during measurement, or a scrape is formed in the traveling traces to such a degree that the strength of the knitting needle is greatly lowered.

(10) DBA Value (Adsorption Amount of Di-n-Butylamine) of Porous Silica

Because di-n-butylamine (DBA) is adsorbed to silanol groups (hydroxyl groups) on a silica surface, the adsorption amount is taken as a measure of hydrophobicity. A lower DBA value signifies that the hydrophobicity is higher. Toluene and DBA are mixed in specified amounts to give a DBA solution. Silica is added to the solution, and the mixture is stirred. As a result, DBA is adsorbed to silanol groups on the silica surface. An amount of excessive DBA remaining in the solution is determined by neutralization titration with an acid. The DBA value (meq/kg) (amount of DBA adsorbed to silica) is determined from the amount of remaining DBA.

EXAMPLE 1

A polytetramethylene ether glycol (number average molecular weight of 2,000) in an amount of 400 parts by weight and 80.1 parts by weight of 4,4'-diphenylmethane diisocyanate were reacted for 3 hours with stirring in a dry nitrogen atmosphere at 80° C. to give a polyurethane prepolymer the molecular terminals of which were each capped with an isocyanate group. The reaction product was cooled to room temperature, and dissolved in dimethylacetamide to give a polyurethane prepolymer solution.

On the other hand, a solution prepared by dissolving 6.55 parts by weight of ethylenediamine and 1.02 parts by weight of diethylamine in dried dimethylacetamide. The solution was added to the above prepolymer solution at room temperature to give a polyurethane solution containing 30% by weight of a polyurethane solid component and having a viscosity of 450 Pa·s (30° C.).

4,4'-butylidenebis(3-methyl-6-t-butylphenol) in an amount of 1% by weight based on the polyurethane solid component, 0.5% by weight of 2-(2'-hydroxy-3'-t-butyl-5'-methylphenyl)-5-chlorobenzotriazole and 1% by weight of porous silica having an average particle size of 2.7 μm, showing a refractive index of 1.46, and having a specific surface area of 500 $m^2/g$ and a DBA value of 800 meq/kg were added to dimethylacetamide, and dispersed by a homomixer to give dispersion liquid (15 wt. %). The dispersions were mixed with the polyurethane solution to form a homogenous solution, which was defoamed under reduced pressure at room temperature to give a spinning dope.

The spinning dope was dry spun at a spinning rate of 800 m/min at a hot air temperature of 310° C. A finishing agent was imparted to the polyurethane elastic fiber thus obtained in an amount of 6% by weight based in the fiber prior to winding the fiber, and the fiber was wound on a paper-made bobbin to give a wound package of the polyurethane elastic fiber of 44 dtex/4 filaments. In addition, an oil agent composed of 57% by weight of a polydimethylsiloxane, 30% by weight of a mineral oil, 1.5% by weight of an amino-modified silicone and 1.5% by weight of magnesium stearate was used as the finishing agent.

Figure 3:
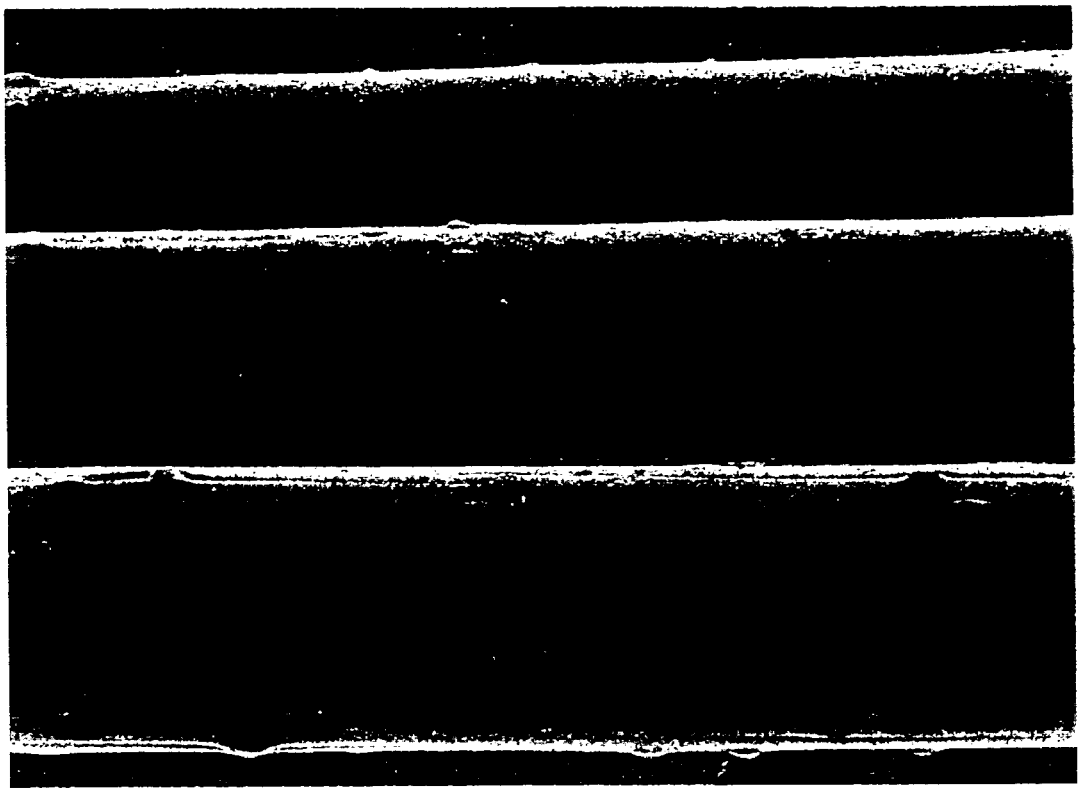
[FIG. 3]

FIG. 3 shows a scanning electron microscopic photograph of the polyurethane elastic fiber thus obtained in Example 1.

EXAMPLE 2

A polyurethane elastic fiber was obtained in the same manner as in Example 1 except that 0.2% by weight of porous silica was added.

EXAMPLE 3

A polyurethane elastic fiber was obtained in the same manner as in Example 1 except that 4.0% by weight of porous silica was added.

EXAMPLE 4

A polyurethane elastic fiber was obtained in the same manner as in Example 1 except that 1% by weight of porous silica having an average particle size of 3.9 μm, showing a refractive index of 1.46, and having a specific surface area of 500 $m^2/g$ and a DBA value of 800 meq/kg was added in place of the porous silica in Example 1.

EXAMPLE 5

A polyurethane elastic fiber was obtained in the same manner as in Example 1 except that 1% by weight of porous silica having an average particle size of 3.1 μm, showing a refractive index of 1.46, and having a specific surface area of 300 $m^2/g$ and a DBA value of 500 meq/kg was added in place of the porous silica in Example 1.

EXAMPLE 6

A polyurethane elastic fiber was obtained in the same manner as in Example 1 except that 0.2% by weight of porous silica having an average particle size of 2.7 μm, showing a refractive index of 1.47, and having a specific surface area of 230 $m^2/g$ and a DBA value of 50 meq/kg was added in place of the porous silica in Example 1.

EXAMPLE 7

A polyurethane elastic fiber was obtained in the same manner as in Example 1 except that 1% by weight of porous silica having an average particle size of 2.7 μm, showing a refractive index of 1.47, and having a specific surface area of 420 $m^2/g$ and a DBA value of 175 meq/kg was added in place of the porous silica in Example 1.

EXAMPLE 8

A polyurethane elastic fiber was obtained in the same manner as in Example 1 except that a polyurethane polymer was obtained by using 400 parts by weight of a copolymerized polyether glycol (copolymerization ratio of a 2,2-dimethylpropylene group: 10% by mole) formed out of tetramethylene groups and 2,2-dimethylpropylene groups and having a number average molecular weight of 2,000 as a polymer polyol in place of the polytetramethylene ether glycol having a number average molecular weight of 2,000 in Example 1.

EXAMPLE 9

A polyurethane elastic fiber was obtained in the same manner as in Example 1 except that 1% by weight of synthetic magnesium silicate having an average particle size of 2.3 μm and showing a refractive index of 1.55 was added in place of the porous silica in Example 1.

EXAMPLE 10

A polyurethane elastic fiber was obtained in the same manner as in Example 1 except that 1% by weight of mica having an average particle size of 4.5 μm and showing a refractive index of 1.49 was added in place of the porous silica in Example 1.

EXAMPLE 11

A polyurethane elastic fiber was obtained in the same manner as in Example 1 except that porous silica was added in an amount of 12% by weight.

EXAMPLE 12

A polyurethane elastic fiber was obtained in the same manner as in Example 1 except that 1% by weight of wet type silica having an average particle size of 2.8 μm, showing a refractive index of 1.46, and having a specific surface area of 150 $m^2/g$ and no inner surface area was added in place of the porous silica in Example 1.

EXAMPLE 13

A polyurethane elastic fiber was obtained in the same manner as in Example 1 except that 1% by weight of dry type silica having an average particle size of 1.9 μm (16 nm by particle size determination with an electron microscope), showing a refractive index of 1.46 and a specific surface area of 170 $m^2/g$ was added in place of the porous silica in Example 1.

Comparative Example 1

A polyurethane elastic fiber was obtained in the same manner as in Example 1 except that porous silica was not added.

Comparative Example 2

A spinning dope was obtained in the same manner as in Example 1 except that 1% by weight of porous silica having an average particle size of 6.2 μm, showing a refractive index of 1.46, and having a specific surface area of 300 $m^2/g$ and a DBA value of 500 meq/kg was added in place of the porous silica in Example 1. The spinning dope thus obtained was dry spun in the same manner as in Example 1. However, yarn breakage often took place, and the pressure drop of the filter increased. As a result, a polyurethane elastic fiber could not be obtained.

Table 1 shows compositions in examples and comparative examples explained above, and Table 2 shows physical properties of the polyurethane elastic fibers thus obtained.

TABLE 1

| | Inorganic compound particles | | | | | | Polymer Polymer diol | |
|---|---|---|---|---|---|---|---|---|
| | | Refractive index | Average particle size (μm) | Addition amount (wt. %) | Specific surface area ($m^2/g$) | DBA value (meq/kg) | | Number average molecular weight |
| Ex. 1 | Porous silica | 1.46 | 2.7 | 1 | 500 | 800 | PTMG | 2000 |
| Ex. 2 | Porous silica | 1.46 | 2.7 | 0.2 | 500 | 800 | PTMG | 2000 |
| Ex. 3 | Porous silica | 1.46 | 2.7 | 4 | 500 | 800 | PTMG | 2000 |
| Ex. 4 | Porous silica | 1.46 | 3.9 | 1 | 500 | 800 | PTMG | 2000 |
| Ex. 5 | Porous silica | 1.46 | 3.1 | 1 | 300 | 500 | PTMG | 2000 |
| Ex. 6 | Porous silica | 1.47 | 2.7 | 0.2 | 230 | 50 | PTMG | 2000 |
| Ex. 7 | Porous silica | 1.47 | 2.7 | 1 | 420 | 175 | PTMG | 2000 |
| Ex. 8 | Porous silica | 1.46 | 2.7 | 1 | 500 | 800 | Cop PTMG | 2000 |
| Ex. 9 | Mg silicate | 1.55 | 2.3 | 1 | — | — | PTMG | 2000 |
| Ex. 10 | Mica | 1.49 | 4.5 | 1 | — | — | PTMG | 2000 |
| Ex. 11 | Porous silica | 1.46 | 2.7 | 12 | 500 | 800 | PTMG | 2000 |
| Ex. 12 | Wet type silica | 1.46 | 2.8 | 1 | 150 | — | PTMG | 2000 |
| Ex. 13 | Dry type silica | 1.46 | 1.9 | 1 | 170 | — | PTMG | 2000 |
| Comp. Ex. 1 | — | — | — | — | — | — | PTMG | 2000 |
| Comp. Ex. 2 | Porous silica | 1.46 | 6.2 | 1 | 300 | 500 | PTMG | 2000 |

Note:

PTMG = Polytetramethylene ether glycol

Cop PTMG = Copolymerized polytetramethylene ether glycol

TABLE 2

| | Protruded portion in surface (number) | Breaking strength (cN) | Breaking elongation (%) | Friction properties Coefficient of dynamic friction against knitting needle ($\mu_d$) | Tension of running yarn (cN) ($T_2$) | Variation in tension ($\Delta T$) | Friction properties Coefficient of static friction Against polyurethane elastic fiber ($\mu_{ss}$) | Against nylon yarn Before leaving ($\mu_{sn}$) | After leaving ($\mu_{sn}$) | Change with time ($\Delta\mu_{sn}$) | Metal abrasion |
|---|---|---|---|---|---|---|---|---|---|---|---|
| Ex. 1 | 10 | 60 | 620 | 0.33 | 3.8 | 0.5 | 0.40 | 0.36 | 0.40 | 0.04 | G |
| Ex. 2 | 3 | 61 | 634 | 0.38 | 3.8 | 0.8 | 0.39 | 0.38 | 0.47 | 0.09 | G |
| Ex. 3 | 83 | 58 | 622 | 0.29 | 3.7 | 0.3 | 0.38 | 0.35 | 0.38 | 0.03 | G |
| Ex. 4 | 12 | 59 | 612 | 0.34 | 3.9 | 0.6 | 0.39 | 0.36 | 0.40 | 0.04 | G |
| Ex. 5 | 8 | 60 | 608 | 0.33 | 3.7 | 0.5 | 0.40 | 0.35 | 0.40 | 0.05 | G |
| Ex. 6 | 4 | 60 | 635 | 0.36 | 3.7 | 0.7 | 0.39 | 0.37 | 0.43 | 0.06 | G |
| Ex. 7 | 11 | 59 | 625 | 0.35 | 3.7 | 0.5 | 0.39 | 0.36 | 0.40 | 0.04 | G |
| Ex. 8 | 9 | 55 | 683 | 0.42 | 3.0 | 0.5 | 0.40 | 0.36 | 0.40 | 0.04 | G |
| Ex. 9 | 5 | 58 | 602 | 0.35 | 3.7 | 0.8 | 0.37 | 0.37 | 0.43 | 0.06 | G |
| Ex. 10 | 3 | 58 | 598 | 0.34 | 3.7 | 0.7 | 0.39 | 0.37 | 0.43 | 0.06 | G–M |
| Ex. 11 | 109 | 38 | 520 | 0.29 | 3.6 | 0.3 | 0.39 | 0.35 | 0.42 | 0.07 | G |
| Ex. 12 | 7 | 55 | 611 | 0.33 | 3.7 | 0.5 | 0.39 | 0.38 | 0.48 | 0.10 | M |
| Ex. 13 | 1 | 60 | 615 | 0.33 | 3.8 | 0.8 | 0.40 | 0.38 | 0.49 | 0.10 | M |
| Comp. Ex. 1 | 0 | 63 | 640 | 0.36 | 3.9 | 1.2 | 0.42 | 0.37 | 0.50 | 0.13 | G |
| Comp. Ex. 2 | Impossible to dry spin | | | | | | | | | | |

INDUSTRIAL APPLICABILITY

Because the polyurethane elastic fiber of the present invention is excellent in texturing stability, yarn breakage hardly occurs, and fabrics of high quality can be produced.

The fabrics for which the polyurethane elastic fiber of the present invention are appropriate are for use in various stretch foundations such as swimwear, girdles, brassieres, intimate goods and underwear, tights, pantyhose, waistbands, bodysuits, spats, stretch sportswear, stretch outerwear, and the like.

The invention claimed is:

1. A polyurethane elastic fiber containing inorganic compound particles that have an average particle size of 0.5 to 5 μm, and that show a refractive index of 1.4 to 1.6, and having at least one protruded portion that has a maximum width of 0.5 to 5 μm in the fiber surface, per 120-μm length in the fiber axis direction.

2. The polyurethane elastic fiber according to claim 1, wherein the polyurethane elastic fiber contains from 0.05 to 10% by weight of inorganic compound particles.

3. The polyurethane elastic fiber according to claim 1, wherein the inorganic compound particles are porous silica having a specific surface area of 100 to 800 $m^2/g$.

4. The polyurethane elastic fiber according to claim 1, wherein the coefficient of dynamic friction thereof against a knitting needle is from 0.2 to 0.6.

5. The polyurethane elastic fiber according to claim 1, wherein the coefficient of static friction thereof against the polyurethane elastic fiber is from 0.3 to 0.6.

6. The polyurethane elastic fiber according to claim 1, wherein the change with time (after allowing the polyurethane elastic fiber to stand for 16 hours at 70° C.) in the coefficient of static friction thereof against a nylon yarn is 0.1 or less.

7. A process for producing a polyurethane elastic fiber, which comprises finely dispersing inorganic compound particles having an average particle size of 0.5 to 5 μm and showing a refractive index of 1.4 to 1.6 in an amide-type polar solvent, and dry spinning a polyurethane spinning dope containing from 0.05 to 10% by weight, based on the polyurethane, of the inorganic compound particles.

8. The polyurethane elastic fiber according to claim 2, wherein the inorganic compound particles are porous silica having a specific surface area of 100 to 800 $m^2/g$.

9. The polyurethane elastic fiber according to claim 8, wherein the coefficient of dynamic friction thereof against a knitting needle is from 0.2 to 0.6.

10. The polyurethane elastic fiber according to claim 9, wherein the coefficient of static friction thereof against the polyurethane elastic fiber is from 0.3 to 0.6.

11. The polyurethane elastic fiber according to claim 10, wherein the change with time (after allowing the polyurethane elastic fiber to stand for 16 hours at 70° C.) in the coefficient of static friction thereof against a nylon yarn is 0.1 or less.

* * * * *

UNITED STATES PATENT AND TRADEMARK OFFICE

CERTIFICATE OF CORRECTION

PATENT NO. : 7,485,364 B2
APPLICATION NO. : 10/591671
DATED : February 3, 2009
INVENTOR(S) : Taro Yamamoto et al.

It is certified that error appears in the above-identified patent and that said Letters Patent is hereby corrected as shown below:

Title Page, Item [57] Column 2 (Abstract), Line 2, change “5mm” to --5μm--.

Signed and Sealed this

Fourteenth Day of April, 2009

JOHN DOLL
*Acting Director of the United States Patent and Trademark Office*